United States Patent [19]

McCrea

[11] 4,236,693

[45] Dec. 2, 1980

[54] PORTABLE WINCH APPARATUS

[76] Inventor: Elmer R. McCrea, 3561 Farm Hill Blvd., Redwood City, Calif. 94061

[21] Appl. No.: 817,792

[22] Filed: Jul. 21, 1977

[51] Int. Cl.[3] ..... B66D 3/26

[52] U.S. Cl. .....254/323; 248/206 R; 248/362; 269/21, 254/326; 280/1; 280/47.34

[58] Field of Search ..... 254/166; 248/206, 346, 248/362, 363, 206 R; 269/21; 294/64 R, 65

[56] References Cited

U.S. PATENT DOCUMENTS

| | | | |
|---|---|---|---|
| 961,093 | 6/1910 | Astor | 248/362 X |
| 1,117,548 | 11/1914 | Bouchery | 248/362 |
| 2,009,721 | 7/1935 | Williams | 248/362 X |
| 2,101,399 | 12/1937 | Larsen | 248/363 X |
| 2,123,549 | 7/1938 | Williams | 248/363 |
| 2,815,240 | 12/1957 | Lytle | 294/64 R |
| 2,945,242 | 7/1960 | Heiden | 248/363 X |
| 3,159,370 | 12/1964 | Rubinstein | 248/362 X |
| 3,758,078 | 9/1973 | Grenn | 254/166 |

FOREIGN PATENT DOCUMENTS

| | | | |
|---|---|---|---|
| 766174 | 6/1934 | France | 254/166 |

*Primary Examiner*—David A. Scherbel
*Attorney, Agent, or Firm*—Marshall C. Gregory

[57] ABSTRACT

This improvement in the field of portable winches or towing devices comprises a shell of heavy construction, which is easily movable on integrally mounted retractable wheels, and which when in its desired location and directional orientation can by its own vacuum pump, mounted thereon, create a vacuum within itself, developing thereby an immobilizing force equivalent to several thousand pounds of weight, enabling the winch mounted thereon to exert a pulling force of magnitude comparable to the immobilizing force, making possible the movement and relocation of heavy objects.

6 Claims, 11 Drawing Figures

PORTABLE WINCH APPARATUS

FIELD OF THE INVENTION

This invention pertains to portable winch apparatus in which the anchoring means is a controllable vacuum.

BACKGROUND OF THE INVENTION

Movable winches are often used in an industrial environment for moving light or heavy equipment from place to place. The apparatus used for moving and/or locking the winch into place is often both bulky and difficult to maneuver as it relies primarily upon its own weight to anchor the winch for use in hauling equipment toward the winch. Alternatively, it may be necessary to bolt the winch securely in place, which requires time and effort.

The use of a controllable vacuum chamber for purposes of anchoring the winch is attractive here, as it allows the use of much smaller machinery for moving and/or holding the winch stationary. The negative pressure of downward-directed atmospheric force developed by a hemispherical vacuum chamber of one foot radius can approach 6700 pounds. A releasable vacuum cup, used for securing a chair to a deck or floor, is disclosed in U.S. Pat. No. 961,093 to Astor, where the top of the vacuum cup is raised and/or depressed by of a rack and pinion to create a partial vacuum within the cup. Evidently, the cup material must be elastic or pliant.

U.S. Pat. No. 2,101,399 to Larsen teaches the use of vacuum cups, again of pliant material, on the landing surfaces of a helicopter or similar vertical descent aircraft so as to restrict vertical or horizontal motion of the aircraft after landing. Each vacuum cup is provided with a valve and a ball and socket mechanism so that the cup may accomodate itself to tilting movement of the aircraft and/or to terrain irregularities. A minimum of three vacuum cups is evidently needed for operation of the invention.

U.S. Pat. No. 2,123,549 to Williams discloses and claims a vacuum cup with a series of concentric layers of ridges or sealing lips, to prevent entrance of moisture and/or loss of vacuum; the entire cup being pliant and self-contouring so as to be useful in holding a tray, for example, on a rounded part of an automobile body. The vacuum pump and valve means are activated by other devices.

Heiden, In U.S. Pat. No. 2,945,242, discloses the use of one or more vacuum cups, activated by a downward force through a mechanical linkage, to make contact with the ground and immobilize the associated structure (wheelchair, rollable table, etc.). Apparently, the novelty in Heiden resides in the use of tubes within the associated structure to bleed the vacuum from the cups.

In U.S. Pat. No. 3,159,370, Rubinstein teaches and claims a vacuum chamber including a rigid convex (hollow) housing open on the bottom; a rubber pad, stretched across the mouth of the housing, a rigid flat surface, being rigidly attached to the central portion of the pad with a shape generally conforming to the interior of the housing; and a crank which causes the pad to move upward against the housing or downward against a flat surface against which the mouth of the housing is pressed so as to create or release a vacuum within the housing, which holds the housing to the surface.

Of the abovementioned patents, only the patent of Rubinstein uses a rigid (non-pliant) vacuum cup, and none of these patents teaches the use of a housing of sufficient size to develop a total immobilization force of several thousand pounds (negative pressure).

SUMMARY OF THE INVENTION

The subject invention is a portable winch apparatus, comprising a substantially rigid housing which is open on the bottom; a resilient seal on the bottom of the housing; a vacuum pump to cause the housing to develop a high vacuum; valve means for releasing a vacuum within the housing; wheel retraction means and one or more retractable wheels, operatively associated with the housing; and a powered winch, attached to the housing.

One object of the invention is to provide a portable winch for moving heavy equipment, the winch itself being easily transported and maneuvered by self-contained transport apparatus.

Other objects and advantages of the subject invention will become clear from the specification and from the following brief description of the drawings.

DETAILED DESCRIPTION

Figure 1:
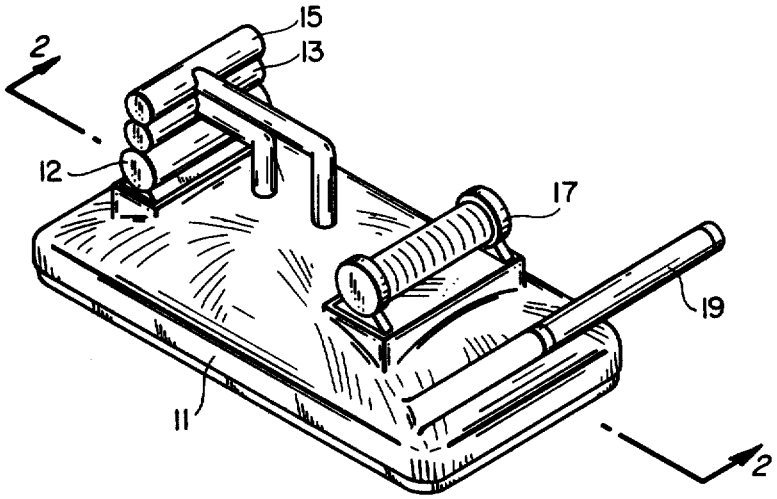
FIG. 1 is a perspective view of the preferred embodiment.

FIG. 1, a perspective of the preferred embodiment, shows a rigid hollow housing 11, open on the bottom and constructed of rigid material which is substantial enough to withstand the pressures generated by a high vacuum within the (closed off) interior of the housing. A vacuum pump 12 and associated pressure chamber 13 are attached to the housing 11, and the pump communicates with the hollow interior and with a second pressure chamber 15 which is used for lowering and raising certain wheels associated with the housing. Rigidly attached elsewhere on the housing exterior is a powered winch 17 with a haul line, used for pulling heavy, movable equipment toward the winch when the housing is held immobile. Finally, a handle 19 (optional) may be attached to the housing 11 to enable an operator to push or pull the portable winch apparatus around when the wheels (not shown) associated with the housing are in their lowered or unretracted position.

Figure 2:
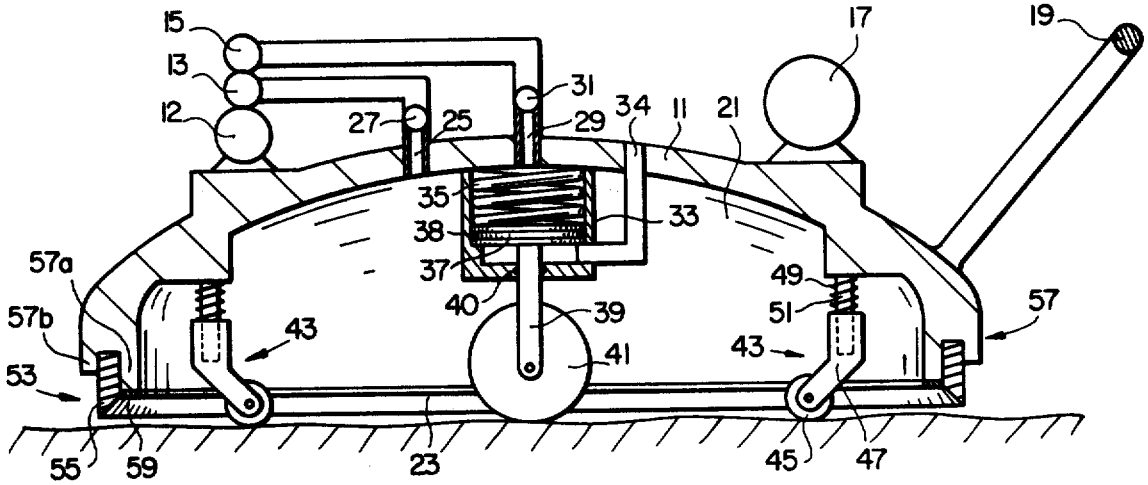
FIG. 2 is a cross sectional side view of the preferred embodiment, showing the rigid housing and some components contained within the housing, with the wheel(s) in the lowered position.

FIG. 2, a cross sectional side view of the preferred embodiment, shows the hollow interior of the rigid housing 11 as well. A vacuum pump 12 is used to evacuate the interior 21 of the hollow housing when the housing is pressed, along the line 23, against a rigid, substantially plane surface so as to define an enclosed region, the housing interior.

The vacuum pump 12 communicates with the housing interior by one or more tubes 25 which pass through a valve 27 and into a chamber 13 associated with the vacuum pump. The vacuum pump 12 may also control the pressure in a second pressure chamber 15 which is connected via one or more tubes 29 and a second (retractor) valve 31 to a third (retractor) pressure chamber 33. The retractor chamber 33 also contains a partly compressed heavy coil spring 35 which is braced against the top of the interior of the chamber 33 and against a movable plate 37 at the bottom of the chamber 33. The movable plate 37 has one or more O-rings 38 on its perimeter so that it can maintain high vacuum with little or no leakage within the retractor chamber 33. The plate is also rigidly attached to a substantially vertically-oriented rod 39 which moves into to and out of the retractor chamber through rod guides 40 positioned at the bottom of the chamber as shown. One or more wheels 41 (two are preferable for ease of balance) are journaled on the rod 39 and are moved up and down in the following manner.

The vacuum is first introduced into the chamber 33 through the valve 31. When the vacuum in 33 reaches a certain negative (gauge) pressure, the vacuum switch 27 is automatically or manually activated and the chamber interior 21 is now evacuated, which locks the rigid housing 11 securely to the ground along line 23.

With the upper part of the retractor chamber 33 maintained at a high vacuum, the atmospheric pressure (15 pounds/in$^2$) on the underside of the movable plate 37 pushes the plate upward (only partly resisted by the compressed coil spring 35) so as to move the bottom of the wheel 41 above the line 23.

A tube 34 connects the lower part of the retractor chamber 33 (lying between the movable plate and the bottom of the chamber 33) with the atmosphere so as to maintain atmospheric pressure in the lower part of said chamber. One or more O-rings are incorporated in the rod guide 40 so as to suppress any leakage from the lower part of the retractor chamber 33 into the evacuated housing interior 21.

When the valves 27 and 31 are opened and the housing interior 21 and retractor chamber 33 are repressurized, the force of the compressed coil spring 35 now causes the plate 37, rod 39 and wheel 41 to move downward so that the bottom of the wheel is now substantially below the line 23 and thus below the bottom of the housing. The coil spring 35 must be sufficiently heavy so that, with the wheel in its lowered position, the spring force will support the rigid housing and hold it above the line 23: the bottom of the wheel 41 is exposed, and the entire unit may thereby be rolled around.

Two or more spring-mounted supplementary wheel balance mechanisms 43 may also be attached to the housing to partially take up the load as the wheel 41 is raised above the line 23; each such mechanism comprises a supplementary wheel 45 mounted on a wheel holder or arm 43 which is slidably received by a spring guide or rod 51, attached to the underside of housing 11 as shown (FIG. 2); spring 49 resists upward sliding, and the arm 47 may swivel about the rod 51. The springs 49 only partially take up the vertical load from the housing 11 as the wheel 41 is raised above the line 23; as said wheel is raised, the weight of the housing overcomes the resistance of the springs 49, and the bottom extremities of the housing (substantially, line 23) move down and contact the ground, at which point further vertical movement stops. The spring mounted wheel mechanisms 43 act primarily as safety devices to prevent or reduce damage to the seal devices 53 mounted on the bottom of the housing 11 as shown; if the housing is somehow accidentally dropped, the velocity of impact of the seal devices with the ground (and the attendant damage) is reduced by the partially resistive upwardly-directed force of the springs 49.

The seal mechanism 53 is comprised of a resilient seal 55 set into a notch 57 in the bottom of the rigid housing 11 as shown; with the inner fork **57*a* of the notch being capped off at the bottom by a shock-absorbing, resilient rubber cap 59 to prevent horizontal slippage and provide additional safety against damage to the seal mechanism 53 by impact from below. The resilient seal 55 is formed from neoprene or polyurethane or other suitable pliant, closed cell materials; as such a material is compressed, the usual elastic resistance abruptly gives way to a stiffer, almost unyielding resistance as the limit of compression of the closed cells is reached. With the closed cells thus compressed (or broken down) to the limit, such as would occur with the housing 11 resting on the seal 55 which rests on the ground, the resilient seal would also serve as a virtually airtight seal so that the high vacuum pulled within the housing interior 21** will not leak appreciably.

Figure 4:
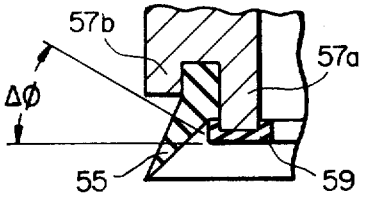
FIGS. 4 and 5 show alternative embodiments of the resilient seal used at the bottom of the housing.
Figure 5:
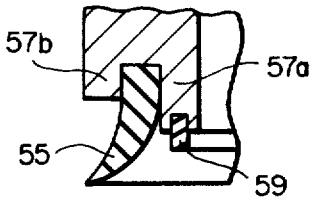

FIGS. 4 and 5 exhibit two useful shape designs (in cross section) of the resilient seal 55 and the rubber cap 59 used for protection against damage impact. Note that, with the bottom of the outer fork **57*b* of the notch set somewhat higher than the line 23** defining the bottom of the housing, the housing can be tipped end-over-end through some modest angle $\Delta\phi$ before said outer fork makes any contact with the ground or otherwise risks damage.

Figure 3:
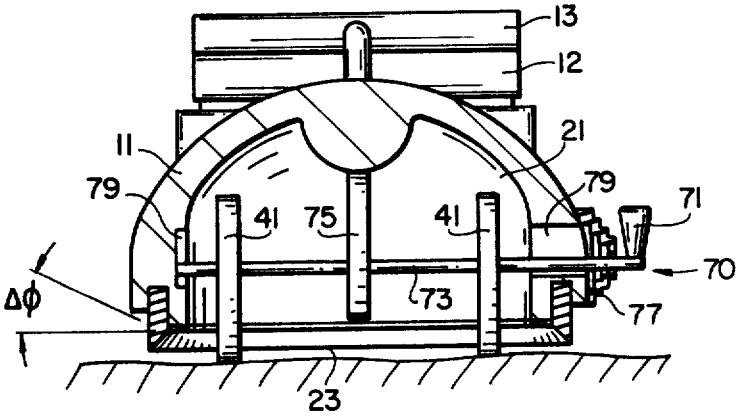
FIG. 3 is a cross sectional front view of a second perferred embodiment, showing the use of a cam and external crank in cooperative relation with the retractable wheel(s) to raise and/or lower the housing.

FIG. 3 exhibits an alternative embodiment in front sectional view, wherein the wheel retraction mechanism (15, 27, 29, 31, 33, 34, 35, 37, 39, 40) in FIG. 2 is replaced by a manually-operated system. A hand-operated crank 70, comprising a handle 71 and a rotator arm 73 rigidly connected together as shown, is rigidly attached to a cam 75; the cam might be a circular disc with the rotator arm attached thereto at a noncentral position. As the crank handle 71 is turned manually to its "up" position (shown in FIG. 3), the cam, which is in contact with and supports the housing 11 from below, causes the housing to move upward relative to the wheels 41 so as to expose the wheels below the housing bottom (line 23) for transport or repositioning of the entire apparatus. As the handle 71 is moved to its "down" position, the rotator arm 73 and cam 75 rotate and allow the housing to move downward so that the housing bottom (line 23) is at least as low as the bottoms of the wheels 41; at this point, the housing rests firmly on the ground, and the housing interior may be evacuated. The rotator arm 73 moves in vertical grooves 79 in the housing side walls, and this tends to hold the housing upright as it moves up and down. A flexible rubber boot 77, positioned at the side of the housing where the rotator arm (which may also be the wheel shaft, as shown) exits from the housing interior 21, allows the arm to move upward and downward within the grooves 79 while maintaining an airtight seal when the housing interior is evacuated.

Figure 6:
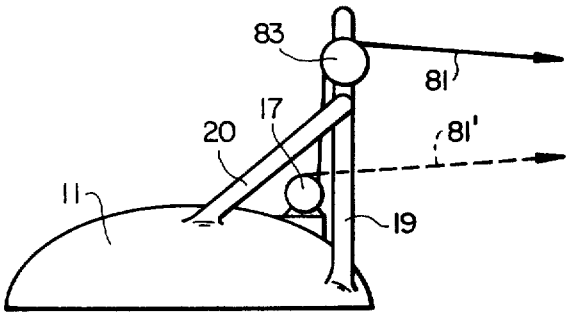
FIG. 6 shows the use of a pulley, journaled in a vertically-locked handle, for use with the winch haul line.

FIG. 6 exhibits another embodiment, wherein the handle 19 may be locked in a substantially verticle position by a movable strut 20 mounted on the housing, with the housing 11 immobilized in the foregoing manner, and with the haul line 81 from the winch 17 passed around a pulley 83 which is journaled near the upper end of the handle as shown. With this embodiment, the haul line force exerted upon the housing (with the housing immobilized) is directed in a more nearly vertical direction than would be the case with a haul line (dotted line 81') going directly to the object to be moved; vertically directed forces on the housing are more easily resisted by the housing 11 (immobilized by a high vacuum within its interior) than is a substantially horizontal force such as that directed along the alternate haul line 81'.

Figure 7:
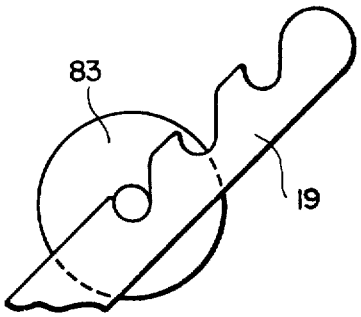
FIG. 7 is a side view of the handle with notches therein for receiving the haul line pulley.

As a further modification, the handle 19 may be provided with substantially semicircular notches, open on one side as shown in FIG. 7, to receive the pulley shaft. This embodiment would allow the pulley to be journaled at any of a number of positions along the handle, as shown, for convenience of hauling.

Figure 8A:
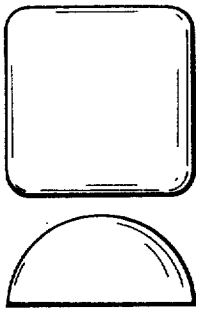
FIGS. 8 (a, b, c) are top and side views of alternative housing shapes.
Figure 8B:
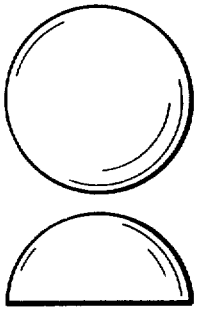
Figure 8C:
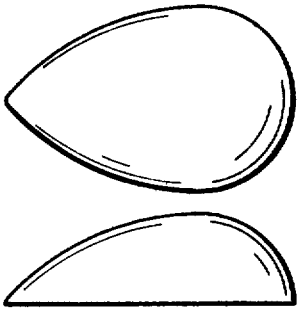

FIGS. 8 a, b, c, exhibit schematically three alternative shapes (top and side views) for the housing 11. The rectangular (or, more generally, polygonal) shape (FIG. 8*a*) allows development of the largest vacuum holding force (through atmospheric pressure) for a housing which requires a given amount of space in an industrial environment. The circular or purely hemispherical shape (FIG. 8*b*, wherein the housing is substantially a hollow hemisphere), substantially equalizes the atmospheric forces when a vacuum is pulled; no special reinforcements of the housing walls are necessary in any case.

The teardrop shape (FIG. 8*c*) requires that the winch be positioned at the rear end of the housing and that the housing winch haul line pass over the housing (toward the apex of the tear drop) and beyond toward the object to be moved. With this latter shape, a taut haul line will exert a force moment on the housing, tending to push the rear portion of the housing upward and to push the front end of the housing downward so as to rotate the housing about some substantially central line.

The teardrop shape (FIG. 8*c*) puts most of the vacuum force (downwardly directed atmospheric pressure) at the rear of the housing, where it is needed to oppose the moment force which is developed.

As another alternative embodiment, the vacuum pump 12 of FIG. 2 may be used in its pressure mode to to create a cushion of air beneath the housing to raise the housing, much as an air hover craft is levitated, allowing the portable winch apparatus to be transported and/or repositioned. However, this would require (1) a stronger pump and (2) special vertically-oriented ducts in the housing interior to concentrate and direct the pressure downward so as to develop sufficient force to levitate the entire apparatus.

Figure 9:
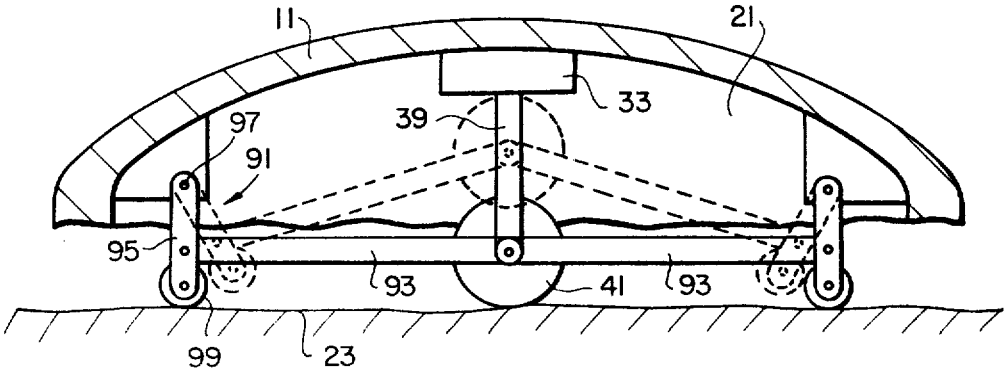
FIG. 9 is a sectional side view, showing an alternative embodiment for raising/lowering the retractable and supplementary balance wheels.

A final embodiment of the subject invention appears in FIG. 9, where the wheel retraction mechanisms of FIG. 2 or FIG. 3 are retained but the spring-mounted wheel mechanisms 43 in FIG. 2 are replaced by supplementary pivotal wheel mechanisms 91, comprising two substantially horizontal rigid arms 93 journaled on the shaft of the wheel 41 at one end of each arm, the other end of each arm being journaled in a rigid supplementary wheel arm 95 which depends downward from the rigid housing 11. Each supplementary wheel arm 95 is journaled at 97 for rotation as shown, and a small wheel 99 is journaled on 95 near the lower end thereof so that the bottom of each supplementary wheel 99 lies somewhat below the line 23 when the corresponding arm 95 hangs vertically downward. As the wheel rod 39 raises the wheel 41, the substantially horizontal arms 93 are rotated at 41 and pulled upward. This causes the supplementary wheel arms 95 to also rotate (for example, to the dotted line position 95' as shown) so that the supplementary wheels 99 are now raised above line 23; the bottom of the rigid housing now contacts the ground. Each wheel arm 95 may be a solid rod, or it may be a substantially hollow tube; in which latter case the supplementary wheel 95 may be a sphere which is rollably held in the bottom of the tube. Finally, the supplementary wheel arm 95 may allowed to swivel about a substantially vertical axis to afford easier transverse movement of the unit.

Although the preferred embodiments of the subject invention have been shown and described herein, it should be clear that variation and modification may be made without departing from what is considered to be the invention.

I claim:

1. Portable winch apparatus comprising:

a substantially rigid, hollow housing, open on the bottom, capable of maintaining a high vacuum when the housing bottom is pressed against a substantially planar, non-porous, rigid surface so as to form a closed chamber;

resilient seal means, attached to the housing on the bottom thereof, for defining substantially a plane to support the housing, when the housing is pressed against a substantially planar surface, while maintaining a vacuum in the closed chamber thus defined;

a vacuum pump to evacuate the closed chamber;

valve means for releasing a vacuum from the closed chamber;

at least one retractable wheel with associated wheel shaft, mounted inside and depending downward from the housing which, in the unretracted position, makes contact with the ground and allows the housing to be rolled about and which, in the retracted position, allows the housing to make contact with the ground;

wheel retraction means, operatively associated with the housing, and with the retractable wheel, for raising and lowering the wheel relative to the housing;

supplementary balance apparatus; and a powered winch, rigidly attached to the housing.

2. Apparatus according to claim 1, wherein said wheel retraction apparatus comprises:

a closed vacuum chamber, operatively associated with said vacuum pump;

inside said closed chamber, a coil spring positioned between and in contact with a movable plate and the top of the closed chamber, the spring being in compression at all positions of the movable plate;

a rod, depending substantially vertically downward from the movable plate;

a wheel, journaled near the lower end of the rod;

valve means, operatively associated with the closed chamber, for controllably releasing a vacuum developed in the chamber;

and pressure maintenance means for maintaining substantially atmospheric pressure in the space between the movable plate and the bottom of the closed chamber, whereby the movable plate, rod and wheel moved upward in response to development of a vacuum in the space between the movable plate and the top of the closed chamber.

3. Apparatus according to claim 1, wherein said wheel retraction apparatus includes:

a crank, with the rotator arm oriented substantially horizontally and journaled in a wall of said rigid housing, the crank handle being positioned outside the housing;

the rotator arm having a cam rigidly attached thereto, with the cam lying beneath and being operatively associated with said rigid housing so that said housing moves upward and downward in response to rotation of the cam by the crank.

4. Apparatus according to claim 1, further including supplementary balance apparatus comprising:

at least two supplementary wheels, each of which lies below the bottom of said housing;

each supplementary wheel being journaled at the lower end of a supplementary wheel rod which depends substantially downward from and is within said housing;

each supplementary wheel rod being journaled on said housing to allow the rod to rotate upward about a substantially horizontal line;

at least two substantially horizontal arms, each arm being journaled at said retractable wheel and at one of the supplementary wheel rods, the orientation of each horizontal arm being substantially perpendicular to the horizontal axis of rotation of the supplementary wheel rod at said housing, whereby the supplementary wheel rods and the supplementary wheels are rotated upward into the interior of said housing as said retractable wheel is raised.

5. Apparatus according to claim 1, wherein said resilient seal means comprises pliant material with the elastic characteristics of closed cell material, depending from the bottom of said rigid housing, wherein the said resilient seal material, partly compressed by the weight of the said rigid housing, thereby seals off the interior of said rigid housing to form an interior chamber in which a vacuum may be induced.

6. Resilient seal means for the bottom of a vacuum chamber as recited in claim 5, further providing that:

the vacuum chamber walls in cross-section contain a notch at the bottom thereof, said notch being vertical in its orientation, and wherein the bottom surface of the outer fork of the notch is substantially higher than the bottom edge of the inner fork; and the seal material depends downwards from said notch lower than the rigid walls of the chamber; and the inner fork of the notch has a resilient cap attached to and depending downwards from from the bottom thereof, to cushion the chamber and limit the compression of the said resilent seal.

* * * * *